US009514668B2

(12) United States Patent
Cho et al.

(10) Patent No.: US 9,514,668 B2
(45) Date of Patent: Dec. 6, 2016

(54) DISPLAY APPARATUS AND CONTROLLING METHOD THEREOF

(71) Applicant: SAMSUNG ELECTRONICS CO., LTD., Suwon-si (KR)

(72) Inventors: Seong-phil Cho, Seoul (KR); Dae-sik Kim, Hwaseong-si (KR); Sung-Soo Kim, Suwon-si (KR); Hwa-seok Seong, Suwon-si (KR); Ho-seop Lee, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 6 days.

(21) Appl. No.: 14/508,036

(22) Filed: Oct. 7, 2014

(65) Prior Publication Data

US 2015/0287355 A1 Oct. 8, 2015

(30) Foreign Application Priority Data

Apr. 2, 2014 (KR) ..... 10-2014-0039179

(51) Int. Cl.

| | |
|---|---|
| ***G09G 5/00*** | (2006.01) |
| ***G09G 3/20*** | (2006.01) |
| ***G09G 3/32*** | (2016.01) |

(52) U.S. Cl.

CPC ..... *G09G 3/2074* (2013.01); *G09G 3/3291* (2013.01); *G09G 2310/027* (2013.01); *G09G 2320/029* (2013.01); *G09G 2320/106* (2013.01)

(58) Field of Classification Search

None

See application file for complete search history.

(56) References Cited

U.S. PATENT DOCUMENTS

2009/0096931 A1* 4/2009 Lee ..... G09G 3/2022 348/699

* cited by examiner

*Primary Examiner* — Joseph Haley

(74) *Attorney, Agent, or Firm* — Sughrue Mion, PLLC

(57) ABSTRACT

A display apparatus is provided. The display apparatus includes: an image input configured to receive an image; a display panel configured to include a plurality of pixels and respectively emit light in the plurality of pixels in order to display the image; a panel driver configured to drive the display panel; and a controller configured to analyze a motion of the image and control the panel driver to drive the display panel by using different driving methods according to a size of the analyzed motion.

12 Claims, 14 Drawing Sheets

FIG. 5A

| | SF1 | SF2 | SF3 | SF4 |
|---|---|---|---|---|
| | 1 | 2 | 4 | 8 |
| 0 | 0 | 0 | 0 | 0 |
| 1 | 1 | 0 | 0 | 0 |
| 2 | 0 | 1 | 0 | 0 |
| 3 | 1 | 1 | 0 | 0 |
| 5 | 1 | 0 | 1 | 0 |
| 6 | 0 | 1 | 1 | 0 |
| 7 | 1 | 1 | 1 | 0 |
| 11 | 1 | 1 | 0 | 1 |
| 13 | 1 | 0 | 1 | 1 |
| 14 | 0 | 1 | 1 | 1 |
| 15 | 1 | 1 | 1 | 1 |

FIG. 5B

| | SF1 | SF2 | SF3 | SF4 |
|---|---|---|---|---|
| | 1 | 2 | 4 | 8 |
| 0 | 0 | 0 | 0 | 0 |
| 1 | 1 | 0 | 0 | 0 |
| 3 | 1 | 1 | 0 | 0 |
| 7 | 1 | 1 | 1 | 0 |
| 15 | 1 | 1 | 1 | 1 |

FIG. 5C

| | SF1 | SF2 | SF3 | SF4 |
|---|---|---|---|---|
| | 1 | 2 | 4 | 0~8 |
| 0 | 0 | 0 | 0 | 0 |
| 1 | 1 | 0 | 0 | 0 |
| 2 | 1 | 0 | 0 | 1 |
| 3 | 1 | 1 | 0 | 0 |
| 4 | 1 | 1 | 0 | 1 |
| 5 | 1 | 1 | 0 | 2 |
| 6 | 1 | 1 | 0 | 3 |
| 7 | 1 | 1 | 1 | 0 |
| 8 | 1 | 1 | 1 | 1 |
| 9 | 1 | 1 | 1 | 2 |
| 10 | 1 | 1 | 1 | 3 |
| 11 | 1 | 1 | 1 | 4 |
| 12 | 1 | 1 | 1 | 5 |
| 13 | 1 | 1 | 1 | 6 |
| 14 | 1 | 1 | 1 | 7 |
| 15 | 1 | 1 | 1 | 8 |

DISPLAY APPARATUS AND CONTROLLING METHOD THEREOF

CROSS-REFERENCE TO RELATED APPLICATION(S)

This application claims priority under 35 U.S.C. §119 from Korean Patent Application No. 10-2014-0039179, filed on Apr. 2, 2014, in the Korean Intellectual Property Office, the disclosure of which is incorporated herein by reference in its entirety.

BACKGROUND

1. Field

The present general inventive concept generally relates to providing a display apparatus and a method of controlling the same, and more particularly, to providing a display apparatus using an organic light-emitting diode (OLED) and a method of controlling the same.

2. Description of the Related Art

In general, a display apparatus divides one frame into a plurality of sub fields and emits light in pixels of each of the sub fields for different times to represent a gray scale value of one frame. For example, if the display apparatus is to represent the frame as 256 gray scales, the display apparatus divides one frame into first through eighth sub fields and emits light in the eight sub fields by weights of 1, 2, 4, 8, 16, 32, 64, and 128 to represent 256 gray scales. However, according to this method, a false contour occurs due to an emission time difference.

FIGS. 1 through 2B are views illustrating problems of an existing display apparatus.

Referring to FIG. 1, pixels a, b, c, d, and e have 127 gray scales, and pixels f, g, h, i, and j have 128 gray scales. In other words, weight values 1, 2, 4, 8, 16, 32, and 64 are respectively given to first through seventh sub fields SF1 through SF7 so that the pixels a, b, c, d, and e have gray scale values. Also, weight value 128 is given to an eighth sub field SF8 so that the pixels f, g, h, i, and j have gray scale values of 128.

Here, when patterns having a gray scale value of 127 and a gray scale value of 128 move at a speed of 6 (pixels and/or frames) to the left, a visual trajectory of a human may be represented as shown in FIG. 1. Here, recognized luminance is represented as shown in FIG. 2B differently from a gray scale value of an original image shown in FIG. 2A. In FIGS. 2A and 2B, the vertical axis denotes a gray scale value, and the horizontal axis denotes a pixel position.

The visual trajectory of the human is positioned in the non-emitting sub fields SF1, SF2, . . . , and SF7 of the pixels f, g, h, i, and j and the non-emitting sub field SF8 of the pixels a, b, c, d, and e so as to allow the human to recognize a gray scale value different from a gray scale value of the original image. This phenomenon mainly appears as a contour form when a pattern having a gently changing gray scale value like a skin tone color moves at a fast speed and is referred to as a false contour. The false contour operates as an important factor degrading a display quality.

As a method of removing such a false contour, there is a method of configuring a plurality of sub fields not to generate non-light-emitting patterns. However, in this method, only gray scale values not having non-light-emitting patterns are used in the plurality of sub fields. Therefore, a gray scale value that may be physically represented in one frame occurs.

SUMMARY

Exemplary embodiments address at least the above problems and/or disadvantages and other disadvantages not described above. Also, the exemplary embodiments are not required to overcome the disadvantages described above, and an exemplary embodiment may not overcome any of the problems described above.

The exemplary embodiments provide a display apparatus that drives a display panel according to different methods based on a motion size of an image to effectively represent all gray scale values, and a method of displaying an image of the display apparatus.

According to an aspect of the exemplary embodiments, there is provided a display apparatus including: an image input configured to receive an image; a display panel configured to include a plurality of pixels and respectively emit light in the plurality of pixels in order to display the image; a panel driver configured to drive the display panel; and a controller configured to analyze a motion of the image and control the panel driver to drive the display panel by using different driving methods according to a size of the analyzed motion.

The controller may control the panel driver to drive the display panel according to a digital driving method in response to the size of the analyzed motion being lower than a preset threshold value and to drive the display panel according to a hybrid driving method, in which the digital driving method and an analog driving method are mixed, in response to the size of the analyzed motion exceeding the preset threshold value.

The digital driving method may be a method of applying a voltage having a constant level to the plurality of pixels for a time corresponding to gray scales respectively represented in a plurality of sub fields constituting a frame of the image. The hybrid driving method may be a method of applying the voltage having a constant level to the plurality of pixels for a time corresponding to gray scale values respectively represented in some of the plurality of sub fields constituting the frame of the image and applying a voltage, having a level corresponding to gray scale values respectively represented in the other sub fields, to the plurality of pixels.

The controller may generate light-emitting patterns of the plurality of sub fields constituting the frame based on a gray scale value of the frame of the image and drive the plurality of sub fields based on the generated light-emitting patterns.

The controller may generate the light-emitting patterns so that non-light-emitting patterns do not exist in the plurality of sub fields in the hybrid driving method.

The controller may compare a plurality of image frames constituting the image to respectively analyze motions of the image frames.

The plurality of pixels may include organic light-emitting diodes (OLEDs).

According to another aspect of the exemplary embodiments, there is provided a method of controlling a display apparatus including a display panel that includes a plurality of pixels and respectively emits light in the plurality of pixels to display an input image. The method may include: receiving an image; and analyzing a motion of the input image and driving the display panel by using different driving methods according to a size of the analyzed motion.

The display panel may be driven according to a digital driving method in response to the size of the analyzed motion being lower than a preset threshold value and may be driven according to a hybrid driving method in which the digital driving method and an analog driving method are mixed, in response to the size of the analyzed motion exceeding the preset threshold value.

The digital driving method may be a method of applying a voltage having a constant level to the plurality of pixels for a time corresponding to gray scales respectively represented in a plurality of sub fields constituting a frame of the image. The hybrid driving method may be a method of applying the voltage having the constant level to the plurality of pixels for a time corresponding to gray scale values respectively represented in some of the plurality of sub fields constituting the frame of the image and applying a voltage, having a level corresponding to gray scale values respectively represented in the other sub fields, to the plurality of pixels.

Light-emitting patterns of a plurality of sub fields constituting a frame may be generated based on a frame of the input image, and the plurality of sub fields may be driven based on the generated light-emitting patterns.

The light-emitting patterns may be generated so that non-light-emitting sub fields do not exist in the plurality of sub fields in the hybrid driving method.

A plurality of image frames constituting the input image may be compared to respectively analyze motions of the image frames.

The plurality of pixels may include OLEDs.

BRIEF DESCRIPTION OF THE DRAWINGS

The above and/or other aspects will be more apparent by describing certain exemplary embodiments with reference to the accompanying drawings, in which:

FIGS. 5A to 5C are views illustrating a digital driving method, according to various exemplary embodiments;

DETAILED DESCRIPTION OF THE EXEMPLARY EMBODIMENTS

Figure 1:
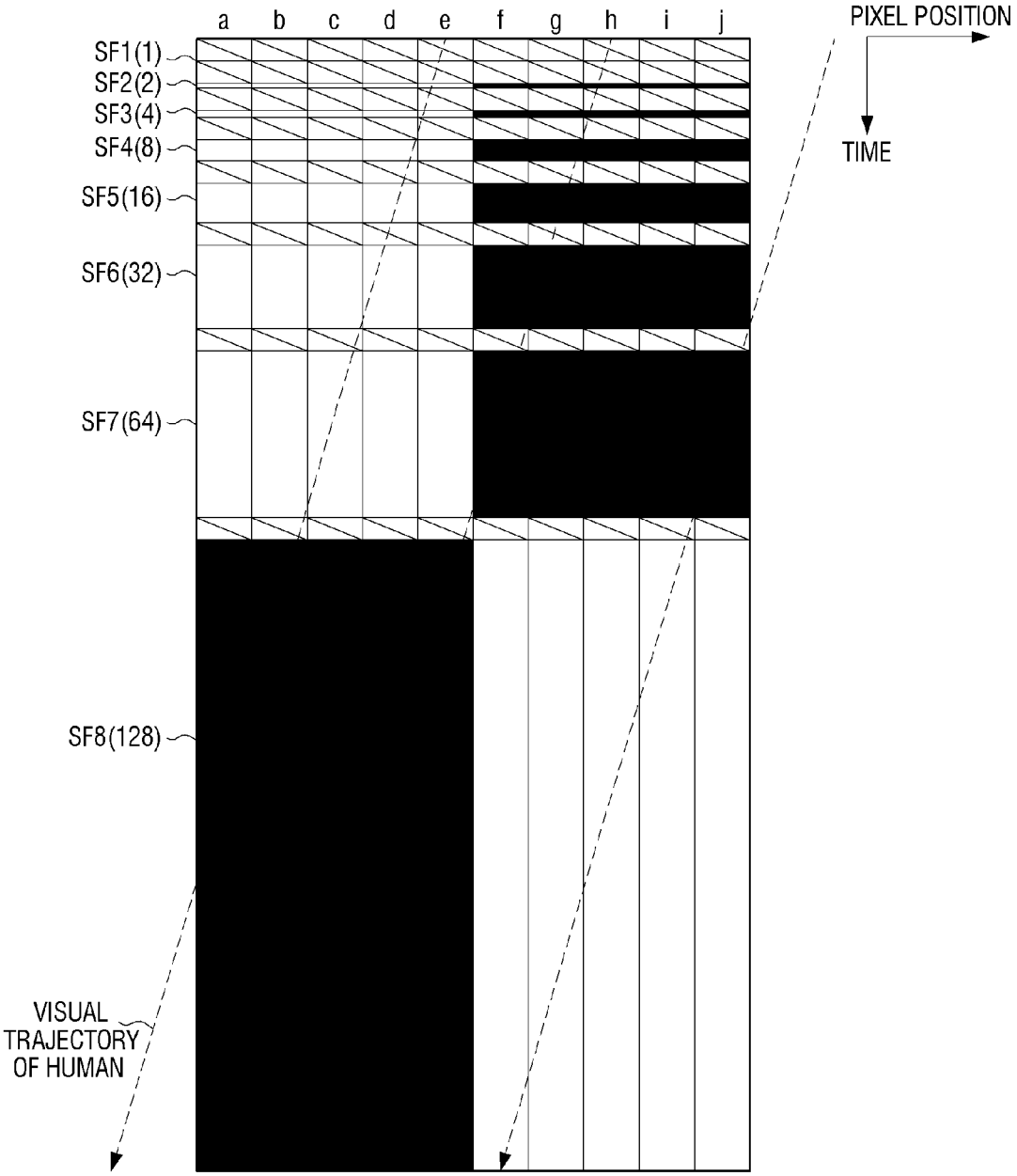
FIG. 1 (RELATED ART)
FIGS. 1 through 2B are views illustrating problems of an existing display apparatus.
Figure 2A:
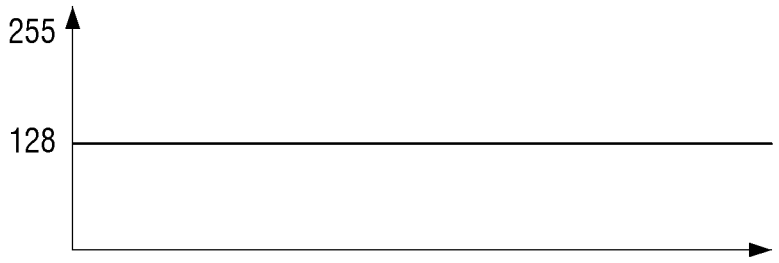
FIG. 2A (RELATED ART)
Figure 2B:
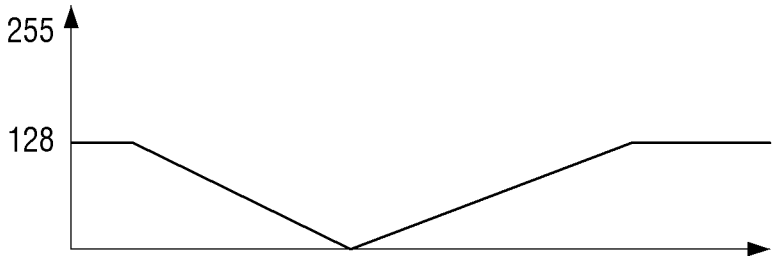
FIG. 2B (RELATED ART)

Exemplary embodiments are described in greater detail with reference to the accompanying drawings.

In the following description, the same drawing reference numerals are used for the same elements even in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail since they would obscure the exemplary embodiments with unnecessary detail.

Figure 3:
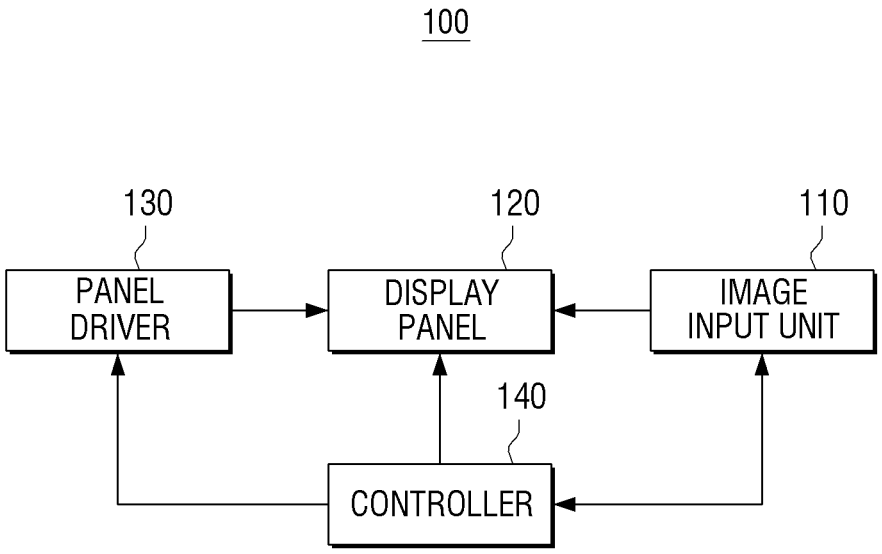
FIG. 3 is a block diagram illustrating a structure of a display apparatus according to an exemplary embodiment.

FIG. 3 is a block diagram illustrating a structure of a display apparatus 100, according to an exemplary embodiment of the present general inventive concept. Referring to FIG. 3, the display apparatus 100 includes an image input 110, a display panel 120, a panel driver 130, and a controller 140.

The image input 110 receives an image. In detail, the image input 110 may receive an image from various types of external apparatuses such as an external storage medium, a broadcasting station, a web server, etc. Here, the input image may be one selected from among a single view image, a stereo image, and a multi-view image.

The display panel 120 includes a plurality of pixels and emits light in each of the plurality of pixels to display the input image. Here, the plurality of pixels may be realized as organic light-emitting diodes (OLEDs) but are not limited thereto.

The panel driver 130 drives the display panel 120. In detail, the panel driver 130 may drive the display panel 120 according to a digital driving method or a hybrid driving method in which a digital driving method and an analog driving method are mixed, under control of the controller 140 that will be described later.

Figure 4A:
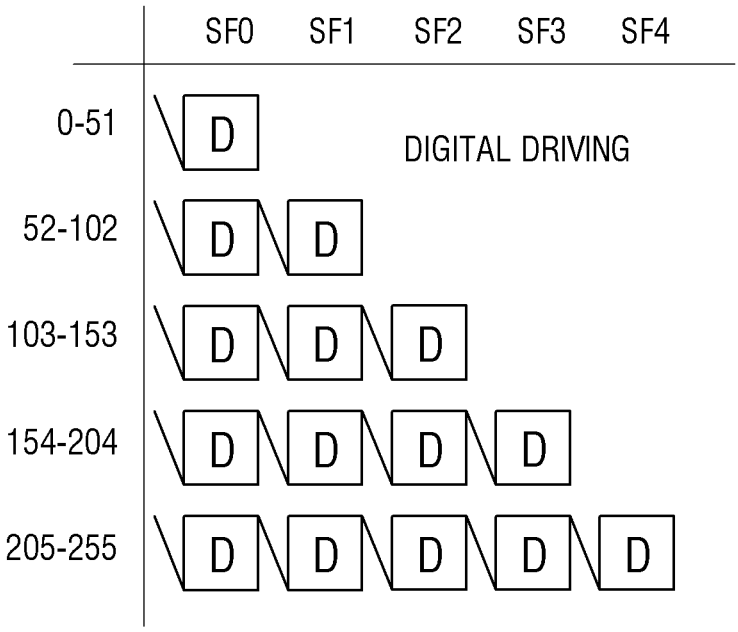
FIGS. 4A and 4B are views illustrating concepts of a digital driving method and a hybrid driving method, according to an exemplary embodiment.
Figure 4B:
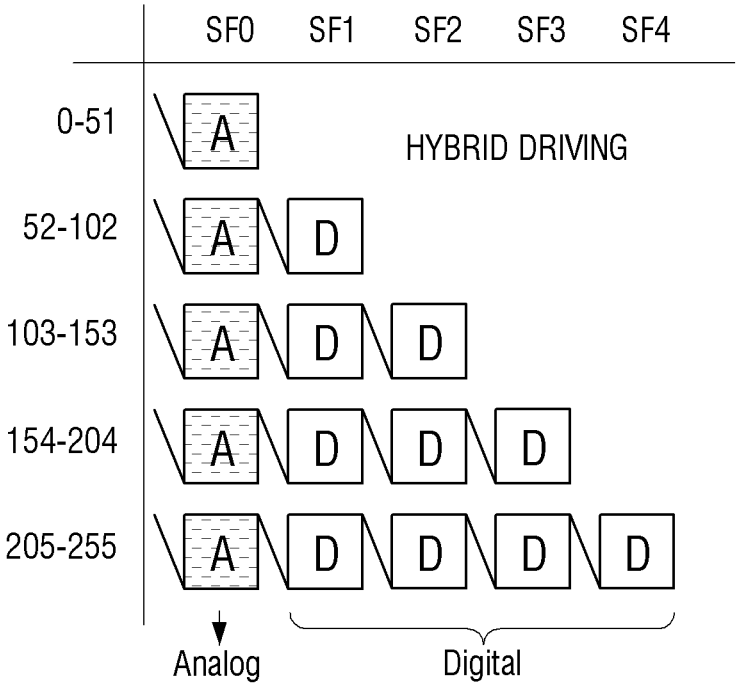

FIGS. 4A and 4B are views illustrating concepts of a digital driving method and a hybrid driving method, according to an exemplary embodiment.

As shown in FIG. 4A, the digital driving method is a method of digitally driving all sub fields constituting an image frame. As shown in FIG. 4B, the hybrid driving method is a method of mixing a digital method and an analog method, i.e., digitally driving some sub pixels and driving the other sub pixels according to an analog method. This will be described in detail later in the description of the controller 140.

The controller 140 controls an overall operation of the display apparatus 100.

In detail, the controller 140 may control the panel driver 130 to analyze a motion of the input image and drive the display panel 120 by using different driving methods according to a size of the analyzed motion. Here, the different driving methods may be the digital driving method or the hybrid driving method that is described above.

The digital driving method refers to a method of applying a voltage having a constant level to a plurality of pixels for a time corresponding to gray scale values respectively represented in a plurality of sub fields constituting a frame of the input image. The analog driving method refers to a method of applying voltages having different levels to the plurality of pixels for a preset time to represent gray scale values respectively corresponding to the sub fields. Therefore, the hybrid driving method refers to a method of applying the voltage having a constant level to the plurality of pixels for a time corresponding to gray scale values respectively represented in some of the plurality of sub fields constituting the frame of the input image, and applying a voltage having a level corresponding to gray scale values respectively represented in the other sub fields to the plurality of pixels. Detailed driving methods of the digital driving method and the hybrid driving method will be described later with reference to the drawings.

In detail, the controller 140 may control the panel driver 130 to drive the display panel 120 according to the digital driving method if the size of the analyzed motion is lower than a preset threshold value and drive the display panel 120 according to the hybrid driving method if the size of the analyzed motion exceeds the preset threshold value.

<Digital Driving Method>

As described above, the controller 140 may control the panel driver 130 to drive the display panel 120 according to the digital driving method if the size of the analyzed motion is lower than the preset threshold value.

In the case of digital driving method, Tr simply operates as a switch. If Tr operates as the switch, there are no effects of electron mobility μ for controlling a current and variations in a threshold voltage Vth of Tr. In other words, since the current is not changed, a uniform screen may be displayed. Therefore, an image frame in which a size of a motion is lower than a preset threshold value, such as a still image frame, may be driven according to the digital driving method.

For example, in order to represent 256 gray scales, one frame of 16.7 ms is divided into eight sub fields, and luminance weights of 1, 2, 4, 8, 16, 32, 64, and 128 are applied to the first through eighth sub fields. Emitting and/or non-emitting states of the sub fields are selected to represent gray scales. For example, if a gray scale value of 127 is represented, light is emitted from the first through seventh sub fields to represent a gray scale. In other words, a gray scale of 1+2+4+8+16+32+64=127 may be represented. FIGS. 5A and 5B are views illustrating a digital driving method, according to various exemplary embodiments of the present general inventive concept.

<Hybrid Driving Method>

If a size of an analyzed motion is higher than or equal to a preset threshold value, the controller 140 may control the panel driver 130 to drive the display panel 120 according to a hybrid driving method.

In this case, the controller 140 may generate light-emitting patterns of a plurality of sub fields constituting a frame based on a gray scale value of an input image frame.

In particular, the controller 140 may generate the light-emitting patterns so that non-light-emitting sub fields do not exist within the plurality of sub fields if the display panel 120 is to be driven according to the hybrid driving method according to the size of the analyzed motion. In detail, the controller 140 generates the light-emitting patterns of the plurality of sub fields so that the non-light-emitting sub fields do not exist and determines gray scale values that to be respectively represented in the sub fields, in order to represent a gray scale value of the frame. Here, gray scale values that may be respectively represented in the sub fields may refer to luminance weights that are respectively applied to the sub fields to represent a gray scale value of one frame by using a plurality of sub fields.

The controller 140 may also determine sub fields, which are to be driven according to a digital driving method and an analog driving method, according to the gray scale values that may be respectively represented in the sub fields to drive the display panel 120 according to a hybrid driving method.

Therefore, in the case of hybrid driving method, under control of the controller 140, the panel driver 130 may apply a voltage having a constant level to a plurality of pixels for a time corresponding to gray scale values respectively represented in some of the sub fields emitting light according to light-emitting patterns and apply a voltage having a level corresponding to gray scale values respectively represented in the other sub fields to a plurality of pixels. Here, the other sub fields may include at least one selected from a plurality of sub fields.

In detail, the panel driver 130 drives a plurality of pixels through at least one selected from the digital driving method and the analog driving method in the sub fields according to the generated light-emitting patterns.

This will now be described in more detail with reference to Table 1 below.

TABLE 1

| Sub Field | SF1 | SF2 |
|---|---|---|
| Luminance Weight | 1 | 0~2 |
| Gray Scale 1 | 1 | 0 |
| Gray Scale 2 | 1 | 1 |

| Sub Field | SF1 | SF2 | SF3 |
|---|---|---|---|
| Luminance Weight | 1 | 2 | 0~4 |
| Gray Scale 3 | 1 | 1 | 0 |
| Gray Scale 4 | 1 | 1 | 1 |
| Gray Scale 5 | 1 | 1 | 2 |
| Gray Scale 6 | 1 | 1 | 3 |

| Sub Field | SF1 | SF2 | SF3 | SF4 |
|---|---|---|---|---|
| Luminance Weight | 1 | 2 | 4 | 0~8 |
| Gray Scale 7 | 1 | 1 | 1 | 0 |
| Gray Scale 8 | 1 | 1 | 1 | 1 |
| Gray Scale 9 | 1 | 1 | 1 | 2 |
| Gray Scale 10 | 1 | 1 | 1 | 3 |
| Gray Scale 11 | 1 | 1 | 1 | 4 |
| Gray Scale 12 | 1 | 1 | 1 | 5 |
| Gray Scale 13 | 1 | 1 | 1 | 6 |
| Gray Scale 14 | 1 | 1 | 1 | 7 |
| Gray Scale 15 | 1 | 1 | 1 | 8 |

For example, the controller 140 may generate light-emitting patterns as shown in Table 1 to represent a frame having gray scale values 0 through 15.

In Table 1, sub fields respectively having luminance weights of 1, 2, and 4 refer to sub fields that are driven according to a digital driving method, and sub fields respectively having luminance weights between 0 and 2, 0 and 4, and 0 and 8 refer to sub fields that are driven according to an analog driving method.

Also, in the sub fields driven according to the digital driving method, 0 and 1 are bits indicating light-emitting states of the sub fields. Pixels are turned off in the sub fields having bits of 0, and pixels are turned on in the sub fields having bits of 1 for a time corresponding to luminance weights of the sub fields to represent the luminance weights of the sub fields. In the sub fields driven according to the analog driving method, a level of a voltage applied to pixels is changed to represent gray scale values of sub fields.

For example, the controller 140 generates light-emitting patterns for driving pixels according to the digital driving method in first through third sub fields SF1 through SF3 so that the first through third sub fields SF1 through SF3 respectively have luminance weights of 1, 2, and 4 to represent a frame having a gray scale value of 7. Also, in order to represent a frame having a gray scale value of 12, the pattern generator 120 (or the display panel 120?) generates light-emitting patterns for driving pixels according to the digital driving method within the first through third sub fields SF1 through SF3 so that the first through third sub fields SF1 through SF3 respectively have luminance weights of 1, 2, and 4 and driving pixels according to the analog driving method within the fourth sub field SF4 so that the fourth sub field SF4 has a luminance weight of 5.

With reference to the light-emitting patterns as shown in Table 1 above, one sub field may be driven according to the analog driving method at each gray scale value of a frame. In other words, the controller 140 may drive pixels according to the digital driving method in sub fields so that the sub fields respectively have luminance weights of 1, 2, 4, and 8 and, if a gray scale value of a frame is not represented only according to the digital driving method, generate light-emitting patterns to drive the pixels according to the analog driving method in the sub fields to represent the corresponding gray scale value. However, this is only an example of a frame having a gray scale value of 15, and at least one sub field may be driven according to the analog driving method.

Figure 6A:
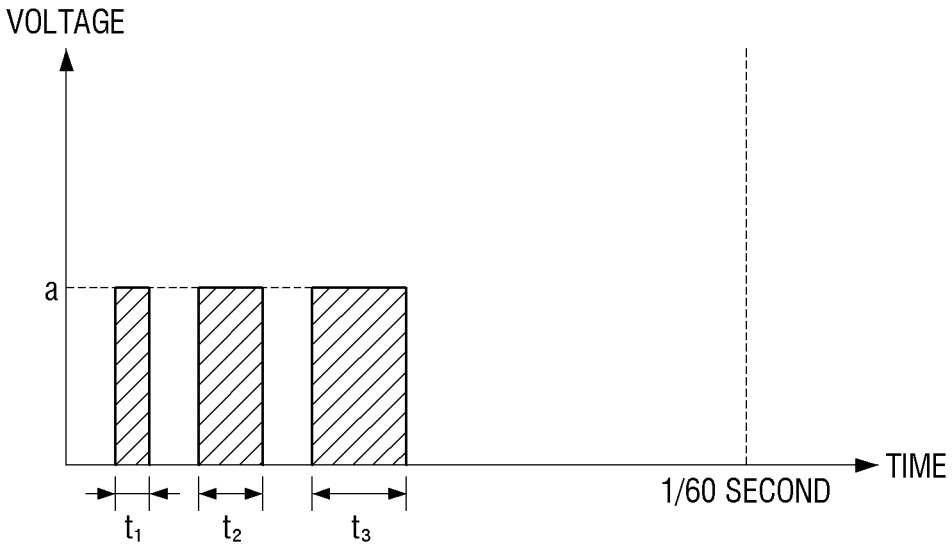
FIGS. 6A and 6B are views illustrating a hybrid driving method in detail, according to an exemplary embodiment.
Figure 6B:
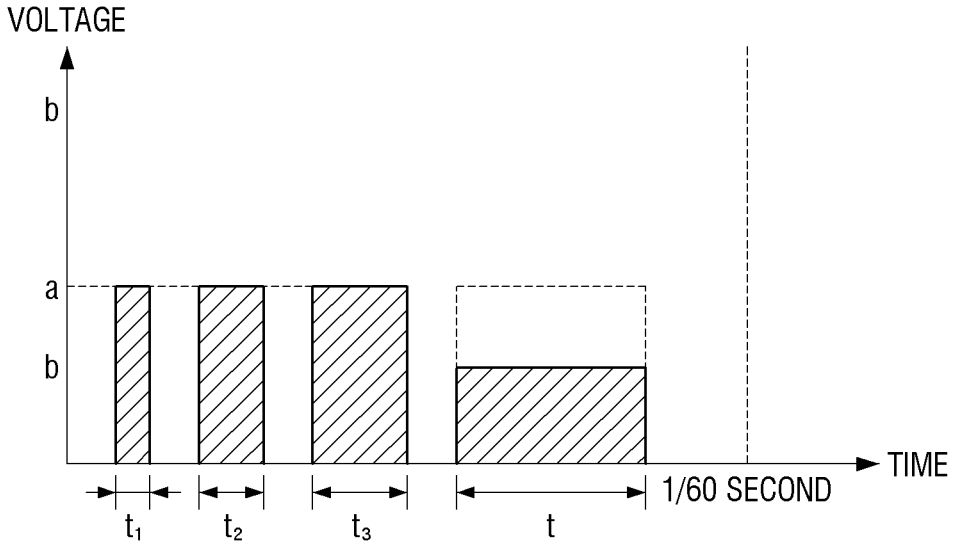

The panel driver 130 may drive pixels based on the light-emitting patterns as shown in Table 1 above under control of the controller 140 to represent a gray scale value of a frame. This will now be described in more detail with reference to FIGS. 6A and 6B. In FIGS. 6A and 6B, an input image signal may have a frame rate of 60 Hz.

For example, as shown in FIG. 6A, under control of the controller 140, the panel driver 130 applies a voltage a having a constant level to pixels within a first sub field SF1 for a time tl to represent a gray scale value of 1 in the first sub field SF1. The panel driver 130 also applies the voltage a having the constant level to the pixels within a second sub field SF2 for a time t2 and applies the voltage a having the constant level to the pixels within a third sub field SF3 for a time t3 to represent gray scale values of 2 and 4. As described above, the panel driver 130 drives the first through third sub fields SF1 through SF3 according to the digital driving method to represent a frame having a gray scale value of 7.

As shown in FIG. 6B, the panel driver 130 drives the first through third sub fields SF1 through SF3 according to the digital driving method to respectively represent gray scale values of 1, 2, and 4. The panel driver 130 applies a voltage b having a level for representing a gray scale value of 5 to pixels for a preset time t to represent the gray scale value of 5 in the fourth sub field SF4. As described above, the panel driver 130 drives the first through third sub fields SF1 through SF3 according to the digital driving method and drives the fourth sub field SF4 according to the analog driving method to represent a frame having a gray scale value of 12.

Therefore, if sub fields are driven only according to the digital driving method, a problem of a false contour occurring in a moving picture may be resolved.

Figure 7:
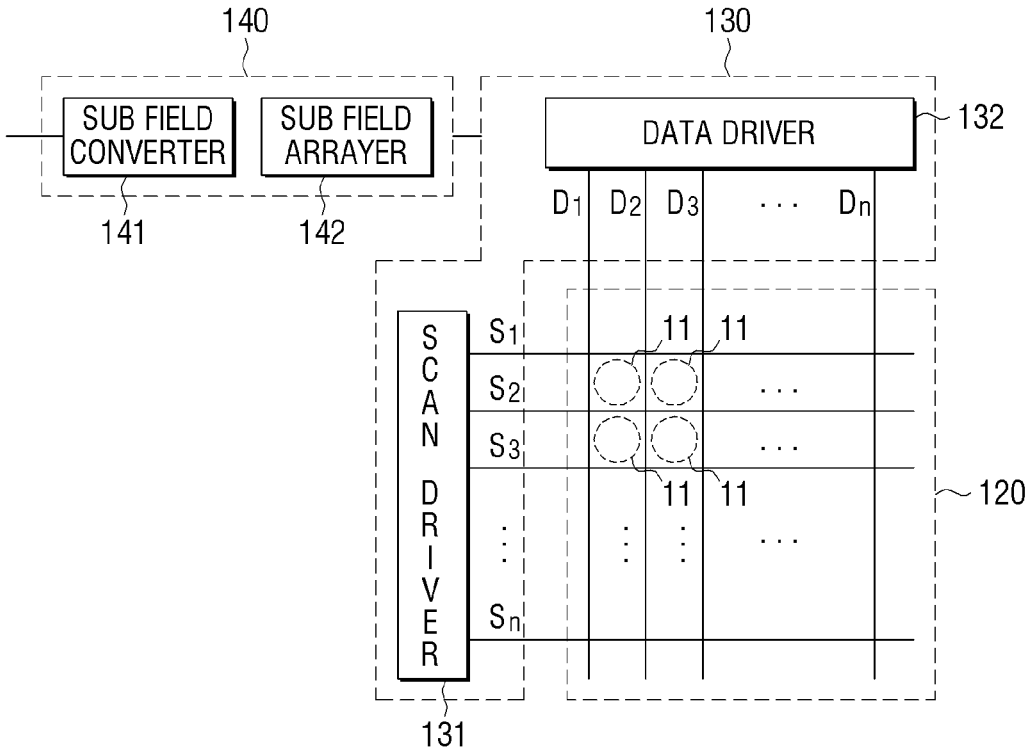
FIG. 7 is a block diagram illustrating a detailed structure of a display apparatus, according to an exemplary embodiment.

FIG. 7 is a block diagram illustrating a detailed structure of a display apparatus, according to an exemplary embodiment of the present general inventive concept. Detailed descriptions of elements of FIG. 7 overlapping with those of FIG. 3 are omitted.

The controller 140 generates light-emitting patterns of a plurality of sub fields based on an input image and transmits an image signal to the panel driver 130. The controller 140 that performs this function may include a sub field converter 141 and a sub field arrayer 142.

The sub field converter 141 generates the light-emitting patterns of the plurality of sub fields constituting a frame based on a gray scale value of a frame of the input image. This has been described in detail above, and thus a repeated description thereof is omitted.

The sub field arrayer 142 receives the light-emitting patterns generated by the sub field converter 141, arrays data in the respective sub fields, and transmits the arrayed data to the panel driver 130. In other words, the sub field arrayer 142 stores data according to sub fields and transmits data about a method of driving pixels in a sub field at a timing at which the corresponding sub field will be represented and about luminance weights of the pixels, to the panel driver 130.

For example, at a time at which the first sub field SF1 will be represented on the display panel 120, the sub field arrayer 142 may transmit data about a driving method and a pixel weight of the first sub field SF1 to the panel driver 130.

The panel driver 120 drives the display panel 120 based on the data of each sub field and the image signal received from the sub field arrayer 142. The panel driver 130 includes a scan driver 131 and a data driver 132.

The scan driver 131 outputs a selection signal through scan lines S1, S2, . . . , and Sn in respective sub fields. If the selection signal is transmitted through the scan lines S1, S2, . . . . , and Sn, pixels 11 are selected according to lines. Here, the pixels 11 that are selected by the selection signal may receive data signals from data lines D1, D2, . . . , and Dn.

The data driver 132 outputs a data signal in plurality of sub fields included in one frame through the data lines D1, D2, . . . , and Dn. Here, the data signals may be a data voltage indicating an input image.

The pixels 11 include OLEDs and are arrayed at intersecting points between the scan lines S1, S2, . . . , and Sn and the data lines D1, D2, . . . , and Dn. The pixels 11 will now be described in more detail with reference to FIG. 8.

Figure 8:
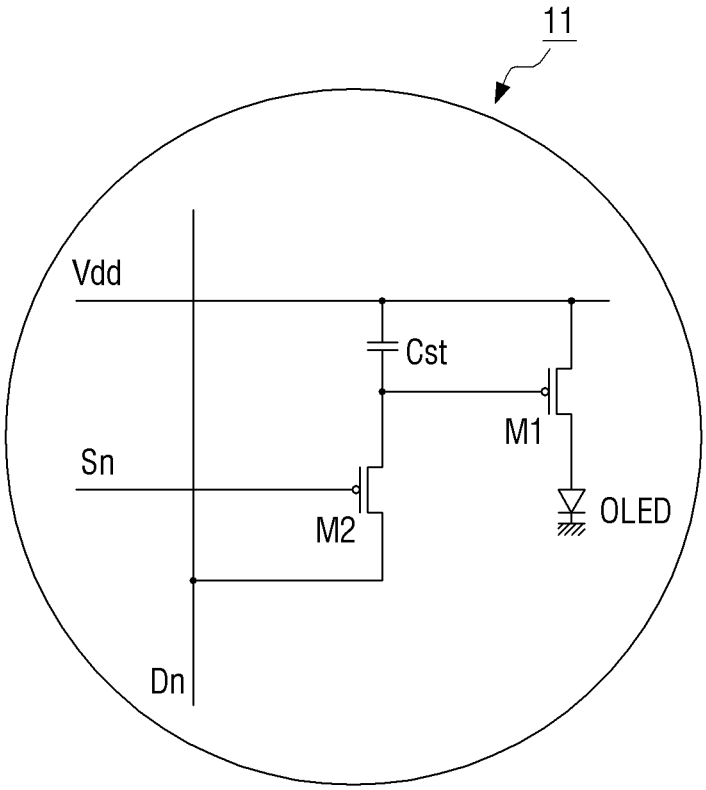
FIG. 8 is a circuit diagram illustrating a pixel, according to an exemplary embodiment.

FIG. 8 is a circuit diagram illustrating a pixel 11, according to an exemplary embodiment of the present general inventive concept.

When a selection signal is supplied through a scan line Sn, the pixel 11 controls an amount of a current that corresponds to a data signal supplied through a data line Dn and is supplied to an OLED. For this, the pixel 11 may include a first transistor M1 that is connected between an external power source Vdd and the OLED, a second transistor M2 that is connected between the first transistor Ml, the data line Dn, and the scan line Sn, and a storage capacitor Cst that is connected between a gate electrode of the first transistor M1 and the external power source Vdd.

If the second transistor M2 is turned on by a selection signal applied to a gate of the second transistor M2, a data signal that is input through the data line Dn is supplied to the storage capacitor Cst. Here, the storage capacitor Cst charges a voltage corresponding to the data signal. The first transistor M1 controls an amount of current that flows from the external power source Vdd to the OLED, according to a voltage value stored in the storage capacitor Cst. Here, the OLED generates light corresponding to an amount of current supplied from the first transistor Ml.

The data driver 132 may control whether the pixel 11 emits light and a light emitting degree of the pixel whenever a scan signal is supplied in each sub field, based on a light-emitting pattern received from the controller 140.

In detail, if a sub field emits light according to the light-emitting pattern, the data driver 132 may supply an appropriate data signal to the pixel 11 in the corresponding sub field to emit light from the pixel 11. Also, if the emitting of the light ends, the data driver 132 may transmit a reset signal to the pixel 11.

In more detail, the data driver 132 may transmit a data signal having a voltage having a constant level to the pixel 11 in a sub field driven according to the digital driving method for a time corresponding to a luminance weight of the sub field. Therefore, in the digital driving method, a light-emitting time of the pixel 11 is adjusted in each sub field to represent a gray scale value corresponding to each sub field.

The data driver 132 may transmit a data signal, having a voltage having a level corresponding to a luminance weight of a sub field driven according to the analog driving method, to the pixel 11 for a preset time. Therefore, in the analog driving method, a level of a voltage applied to the pixel 11 is adjusted in each sub field to represent a gray scale value corresponding to each sub field.

Figure 9:
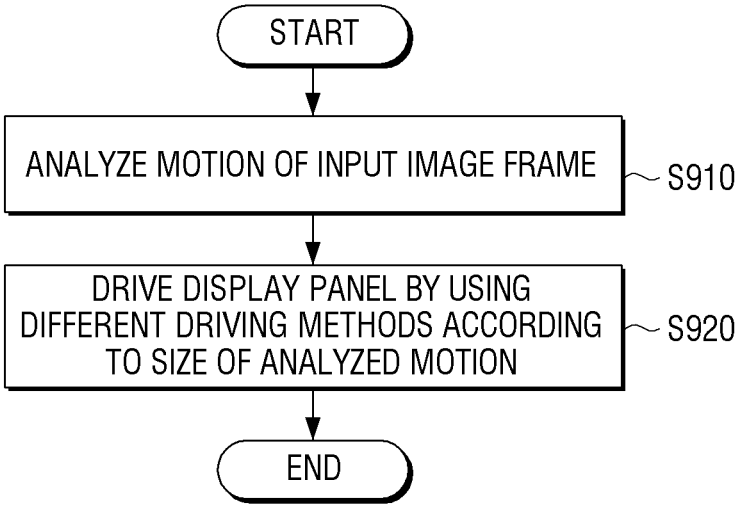
FIG. 9 is a flowchart illustrating a method of controlling a display apparatus, according to an exemplary embodiment.

FIG. 9 is a flowchart illustrating a method of controlling a display apparatus, according to an exemplary embodiment of the present general inventive concept.

Referring to FIG. 9, the display apparatus includes a display panel that includes a plurality of pixels and respectively emits light in the plurality of pixels to display an input image. In operation S910, the display apparatus analyzes a motion of the input image. In operation S920, the display apparatus drives the display panel by using different driving methods according to the size of the analyzed motion.

In operation S920, if the size of the analyzed motion is lower than a preset threshold value, the display apparatus may drive the display panel according to a digital driving method and, if the size of the analyzed motion exceeds the preset threshold value, drive the display panel according to a hybrid driving method in which the digital driving method and an analog driving method are mixed.

Here, the digital driving method refers to a method of applying a voltage having a constant level to a plurality of pixels for a time corresponding to gray scale values respectively represented in a plurality of sub fields constituting a frame of an input image. The hybrid driving method may be a method of applying the voltage having the constant level to the plurality of pixels for a time corresponding to gray scale values respectively represented in some of the plurality of sub fields and applying a voltage having a level corresponding to gray scale values respectively represented in the other sub fields to the plurality of pixels.

Also, in operation S920, the display apparatus may generate light-emitting patterns of the plurality of sub fields constituting the frame based on a gray scale value of the frame of the input image and determine driving methods of the plurality of sub fields based on the generated light-emitting patterns.

In addition, in operation S920, the display apparatus may generate the light-emitting patterns so that non-light emitting sub fields do not exist in the plurality of sub fields.

In operation S920, the display apparatus may compare a plurality of image frames constituting the input image to respectively analyze motions of the image frames.

The plurality of pixels may include OLEDs.

According to various exemplary embodiments described above, a panel may be driven by using an appropriate driving method according to a motion size of an input image.

A controlling method according to the above-described exemplary embodiments may be realized as a program and then provided to a display apparatus.

A non-transitory computer-readable medium refers to a medium which does not store data for a short time such as a register, a cache memory, a memory, or the like but semi-permanently stores data and is readable by a device. In detail, the above-described various applications or programs may be stored and provided on a non-transitory computer readable medium such as a CD, a DVD, a hard disk, a blue-ray disk, a universal serial bus (USB), a memory card, a ROM, or the like.

The foregoing exemplary embodiments are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A display apparatus comprising:

an image input configured to receive an image;

a display panel configured to comprise a plurality of pixels and respectively emit light in the plurality of pixels in order to display the image;

a panel driver configured to drive the display panel; and a controller configured to analyze a motion of the image and control the panel driver to drive the display panel by using different driving methods according to a size of the analyzed motion, wherein the controller controls the panel driver to drive the display panel according to a digital driving method in response to the size of the analyzed motion being lower than a preset threshold value and controls the panel driver to drive the display panel according to a hybrid driving method in which the digital driving method and an analog driving method are mixed in response to the size of the analyzed motion being higher than or equal to the preset threshold value.

2. The display apparatus of claim 1, wherein:

the digital driving method is a method of applying a voltage having a constant level to the plurality of pixels for a time corresponding to gray scales respectively represented in a plurality of sub fields constituting a frame of the image; and the hybrid driving method is a method of applying the voltage having the constant level to the plurality of pixels for a time corresponding to gray scale values respectively represented in some of the plurality of sub fields constituting the frame of the image and applying a voltage, having a level corresponding to gray scale values respectively represented in the other sub fields, to the plurality of pixels.

3. The display apparatus of claim 2, wherein the controller generates light-emitting patterns of the plurality of sub fields constituting the frame based on a gray scale value of the frame of the image and drives the plurality of sub fields based on the generated light-emitting patterns.

4. The display apparatus of claim 3, wherein the controller generates the light-emitting patterns so that non-light-emitting patterns do not exist in the plurality of sub fields in the hybrid driving method.

5. The display apparatus of claim 1, wherein the controller compares a plurality of image frames constituting the image to respectively analyze motions of the image frames.

6. The display apparatus of claim 1, wherein the plurality of pixels comprise organic light-emitting diodes (OLEDs).

7. A method of controlling a display apparatus comprising a display panel that comprises a plurality of pixels and respectively emits light in the plurality of pixels to display an input image, the method comprising:

receiving an image; and analyzing a motion of the input image and driving the display panel by using different driving methods according to a size of the analyzed motion, wherein the driving the display panel comprises driving the display panel according to a digital driving method in response to the size of the analyzed motion being lower than a preset threshold value, and driving the display panel according to a hybrid driving method in which the digital driving method and an analog driving method are mixed in response to the size of the analyzed motion being higher than or equal to the preset threshold value.

8. The method of claim 7, wherein:

the digital driving method is a method of applying a voltage having a constant level to the plurality of pixels for a time corresponding to gray scales respectively represented in a plurality of sub fields constituting a frame of the image; and the hybrid driving method is a method of applying the voltage having the constant level to the plurality of pixels for a time corresponding to gray scale values respectively represented in some of the plurality of sub fields constituting the frame of the image and applying a voltage, having a level corresponding to gray scale values respectively represented in the other sub fields, to the plurality of pixels.

9. The method of claim 8, wherein light-emitting patterns of a plurality of sub fields constituting a frame are generated based on a frame of the input image, and the plurality of sub fields are driven based on the generated light-emitting patterns.

10. The method of claim 9, wherein the light-emitting patterns are generated so that non-light-emitting sub fields do not exist in the plurality of sub fields in the hybrid driving method.

11. The method of claim 7, wherein a plurality of image frames constituting the input image are compared to respectively analyze motions of the image frames.

12. The method of claim 7, wherein the plurality of pixels comprise OLEDs.

* * * * *